US008907870B2

(12) United States Patent
Kang et al.

(10) Patent No.: US 8,907,870 B2
(45) **Date of Patent: *Dec. 9, 2014**

(54) PIXEL AND ORGANIC LIGHT EMITTING DISPLAY DEVICE USING THE PIXEL

(75) Inventors: Chul-Kyu Kang, Yongin (KR); Yu-Lian Choi, Yongin (KR); Keum-Nam Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 1233 days.

This patent is subject to a terminal disclaimer.

(21) Appl. No.: 12/693,388

(22) Filed: Jan. 25, 2010

(65) Prior Publication Data

US 2010/0265166 A1 Oct. 21, 2010

(30) Foreign Application Priority Data

Apr. 17, 2009 (KR) ..... 10-2009-0033571

(51) Int. Cl.
*G09G 3/30* (2006.01)

(52) U.S. Cl.
USPC ..... 345/76; 345/77

(58) Field of Classification Search
USPC ..... 345/76–83
See application file for complete search history.

(56) References Cited

U.S. PATENT DOCUMENTS

| | | | |
|---|---|---|---|
| 7,710,368 | B2 | 5/2010 | Chung |
| 8,149,186 | B2 | 4/2012 | Kim |
| 2006/0066532 | A1 | 3/2006 | Jeong |
| 2008/0231199 | A1 | 9/2008 | Yamamoto et al. |
| 2009/0109150 | A1 | 4/2009 | Han et al. |
| 2009/0167364 | A1 | 7/2009 | Bramante et al. |

FOREIGN PATENT DOCUMENTS

| | | | |
|---|---|---|---|
| EP | 2192571 | A2 | 6/2010 |
| EP | 2242039 | B1 | 10/2010 |

(Continued)

OTHER PUBLICATIONS

KIPO Office action dated Dec. 6, 2010 issued in priority Korean application No. KR 10-2009-0033571 (2 sheets).

(Continued)

*Primary Examiner* — Jonathan Horner

(74) *Attorney, Agent, or Firm* — Christie, Parker & Hale, LLP

(57) ABSTRACT

A pixel includes an organic light emitting diode; a first transistor; a second transistor coupled to a data line and turned on when a scan signal is supplied to an $i^{th}$ scan line; a third transistor between the second transistor and a gate electrode of the first transistor and turned on when a scan signal is supplied to an $i+1^{th}$ scan line; a fourth transistor between the gate electrode of the first transistor and a reference power supply and turned on when the scan signal is supplied to the $i^{th}$ scan line; a fifth transistor between the organic light emitting diode and an initial power supply and turned on when a control signal is supplied; a first capacitor between the organic light emitting diode and a node between the second transistor and the third transistor; and a second capacitor between the node and the gate electrode of the first transistor.

13 Claims, 4 Drawing Sheets

(56) References Cited

FOREIGN PATENT DOCUMENTS

| | | | |
|---|---|---|---|
| JP | 2004-280059 | | 10/2004 |
| JP | 2006-113586 | | 4/2006 |
| JP | 2006-195459 | | 7/2006 |
| JP | 2008-176287 | | 7/2008 |
| KR | 10-2005-0104971 | A | 11/2005 |
| KR | 10-2006-0112990 | A | 11/2006 |
| KR | 10-2007-0111634 | A | 11/2007 |
| KR | 1020070116389 | A | 12/2007 |
| KR | 10-2008-0000468 | A | 1/2008 |
| KR | 10-2008-0067856 | A | 7/2008 |
| KR | 10-2008-0080754 | A | 9/2008 |
| KR | 10-2009-0071385 | A | 7/2009 |
| WO | WO 2008/075697 A1 * | | 6/2008 |

OTHER PUBLICATIONS

European Search Report dated Aug. 6, 2010, for corresponding European Patent application 10157732.8.

Office action dated Apr. 3, 2012 of the Japanese Patent Application No. 2009-207022, which claims priority of the corresponding Korean priority application No. 10-2009-0033571.

KIPO Notice of Allowance dated Sep. 30, 2011, for Korean Patent Application 10-2010-0000571, (5 pages).

U.S. Notice of Allowance dated Jul. 11, 2012, for cross reference U.S. Appl. No. 12/869,721 (now U.S. Patent 8,284,136), (13 pages).

* cited by examiner

PIXEL AND ORGANIC LIGHT EMITTING DISPLAY DEVICE USING THE PIXEL

CROSS-REFERENCE TO RELATED APPLICATIONS

This application claims priority to and the benefit of Korean Patent Application No. 10-2009-0033571, filed on Apr. 17, 2009, in the Korean Intellectual Property Office, the entire content of which is incorporated herein by reference.

BACKGROUND

1. Field

The following description relates to a pixel and an organic light emitting display device using the pixel.

2. Description of Related Art

Recently, various flat panel display devices having reduced weight and volume, as compared to cathode ray tubes, have been developed. Among these flat panel display devices, are liquid crystal display devices, field emission display devices, plasma display panels, and organic light emitting display devices, among others.

Among these flat panel display devices, the organic light emitting display device displays an image using organic light emitting diodes that generate light by the recombination of electrons and holes. Such an organic light emitting display device is driven at low power consumption and has rapid response times.

FIG. 1 is a circuit view showing a pixel of a conventional organic light emitting display device. In FIG. 1, transistors included in the pixel are NMOS transistors.

Referring to FIG. 1, the pixel 4 of the conventional organic light emitting display device includes an organic light emitting diode OLED, and a pixel circuit 2 that is coupled to a data line Dm and a scan line Sn to control the organic light emitting diode OLED.

The anode electrode of the organic light emitting diode OLED is coupled to the pixel circuit 2, and the cathode electrode thereof is coupled to a second power supply ELVSS. Such an organic light emitting diode OLED generates light having a predetermined brightness corresponding to current supplied from the pixel circuit 2.

The pixel circuit 2 controls an amount of current supplied to the organic light emitting diode OLED corresponding to the data signal supplied to the data line Dm when a scan signal is supplied to the scan line Sn. The pixel circuit 2 includes a second transistor M2 coupled between a first power supply ELVDD and the organic light emitting diode OLED, a first transistor M1 coupled between the second transistor M2 and the data line Dm and having a gate electrode coupled to the scan line Sn, and a storage capacitor coupled between the gate electrode and the first electrode of the second transistor M2.

The gate electrode of the first transistor M1 is coupled to the scan line Sn, and the first electrode thereof is coupled to the data line Dm. The second electrode of the first transistor M1 is coupled to one terminal of the storage capacitor Cst. Here, the first electrode is either a source electrode or a drain electrode, and the second electrode is the other of the source electrode or the drain electrode. For example, if the first electrode is a drain electrode, the second electrode is a source electrode. When the scan signal is supplied from the scan line Sn, the first transistor M1 coupled the data line Dm is turned on to supply the data signal from the data line Dm to the storage capacitor Cst. At this time, the storage capacitor Cst is charged with a voltage corresponding to the data signal.

The gate electrode of the second transistor M2 is coupled to one terminal of the storage capacitor Cst, and the first electrode thereof is coupled to the first power supply ELVDD. The second electrode of the second transistor M2 is coupled to the other terminal of the storage capacitor Cst and the anode electrode of the organic light emitting diode OLED. The second transistor M2 controls the amount of current flowing from the first power supply ELVDD to the second power supply ELVSS via the organic light emitting diode OLED corresponding to the voltage stored in the storage capacitor Cst.

One terminal of the storage capacitor Cst is coupled to the gate electrode of the second transistor M2, and the other terminal thereof is coupled to the anode electrode of the organic light emitting diode OLED. The storage capacitor Cst is charged with a voltage corresponding to the data signal.

The conventional pixel as described above displays an image having a predetermined brightness by supplying current corresponding to the voltage charged in the storage capacitor Cst to the organic light emitting diode OLED. However, the conventional organic light emitting display device cannot display an image having a uniform brightness due to deviations of the threshold voltages of the second transistors M2 in different pixels of the display device.

When the respective pixels 4 have different threshold voltages, the respective pixels 4 generate light having different brightness despite receiving a same data signal, such that an image having a uniform or desired brightness is difficult to display.

SUMMARY OF THE INVENTION

Therefore, exemplary embodiments of the present invention provide a pixel for displaying an image having a uniform brightness, irrespective of the threshold voltage of the driving transistor of the pixel, and an organic light emitting display device using the pixel.

According to an exemplary embodiment of the present invention, there is provided a pixel, including: an organic light emitting diode having a cathode electrode coupled to a second power supply; a first transistor for controlling an amount of current flowing from a first power supply to the second power supply through the organic light emitting diode; a second transistor coupled to a data line and turned on when a scan signal is supplied to an $i^{th}$ (i is a natural number) scan line; a third transistor coupled between the second transistor and a gate electrode of the first transistor and turned on when a scan signal is supplied to an $i+1^{th}$ scan line; a fourth transistor coupled between the gate electrode of the first transistor and a reference power supply and turned on when the scan signal is supplied to the $i^{th}$ scan line; a fifth transistor coupled between an anode electrode of the organic light emitting diode and an initial power supply and is turned on when a control signal is supplied to a control line; a first capacitor coupled between the anode electrode of the organic light emitting diode and a node between the second transistor and the third transistor; and a second capacitor coupled between the node and the gate electrode of the first transistor.

The fifth transistor may be turned on during a portion of a time period when the second transistor is turned on. The fifth transistor may be turned on concurrently with the second transistor. The reference power supply may have a voltage greater than a voltage of the initial power supply.

According to another exemplary embodiment of the present invention, there is provided an organic light emitting display, including: a scan driver for supplying scan signals sequentially to scan lines and supplying control signals sequentially to control lines; a data driver for supplying data signals to data lines in accordance with the scan signals; and pixels at crossing regions of the scan lines, the control lines and the data lines, wherein a pixel of the pixels positioned at an $i^{th}$ (i is a natural number) scan line of the scan lines includes: an organic light emitting diode having a cathode electrode coupled to a second power supply; a first transistor for controlling an amount of current flowing from a first power supply to the second power supply through the organic light emitting diode; a second transistor coupled to a data line of the data lines and turned on when the scan signal is supplied to the $i^{th}$ scan line; a third transistor coupled between the second transistor and a gate electrode of the first transistor and turned on when a scan signal is supplied to an $i+1^{th}$ scan line; a fourth transistor coupled between the gate electrode of the first transistor and a reference power supply and turned on when the scan signal is supplied to the $i^{th}$ scan line; a fifth transistor coupled between an anode electrode of the organic light emitting diode and an initial power supply and turned on when the control signal is supplied to an $i^{th}$ control line of the control lines; a first capacitor coupled between the anode electrode of the organic light emitting diode and a node between the second transistor and the third transistor; and a second capacitor coupled between the node and the gate electrode of the first transistor.

A voltage of a data signal supplied to the data line may be greater than or equal to a voltage of the reference power supply. The initial power supply may have a voltage lower than a voltage obtained by subtracting a threshold voltage of the first transistor from a voltage of the reference power supply. The initial power supply may be set at a voltage for turning the organic light emitting diode off. The scan driver may be configured to supply the control signal to the $i^{th}$ control line during a portion of a time period when the scan signal is supplied to the $i^{th}$ scan line. The scan driver may be configured to supply the control signal to the $i^{th}$ control line concurrently with the scan signal supplied to the $i^{th}$ scan line.

With the pixel and the organic light emitting display device using the pixel according to exemplary embodiments of the present invention, an image having a uniform or desired brightness can be displayed, irrespective of deviations in the threshold voltages of the driving transistors of different pixels in the display device.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF EXEMPLARY EMBODIMENTS

Figure 1:
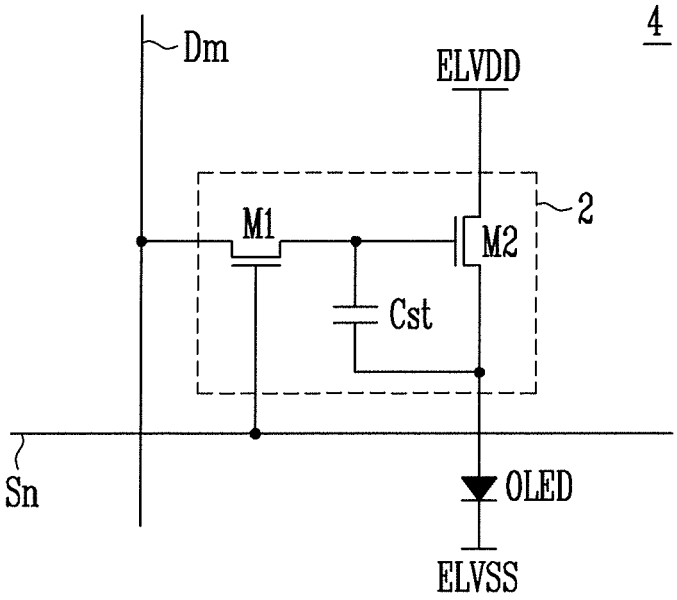
FIG. 1 (PRIOR ART)
FIG. 1 is a circuit view showing a conventional pixel.

Hereinafter, certain exemplary embodiments according to the present invention will be described, with reference to the accompanying drawings. Here, when a first element is described as being coupled to a second element, the first element may be directly coupled to the second element, or may be indirectly coupled to the second element via one or more additional elements. Further, some of the elements that are not essential to the complete understanding of the invention are omitted for clarity. Also, like reference numerals refer to like elements throughout.

Hereinafter, exemplary embodiments of the present invention will be described in more detail with reference to the accompanying FIGS. 2 to 5.

Figure 2:
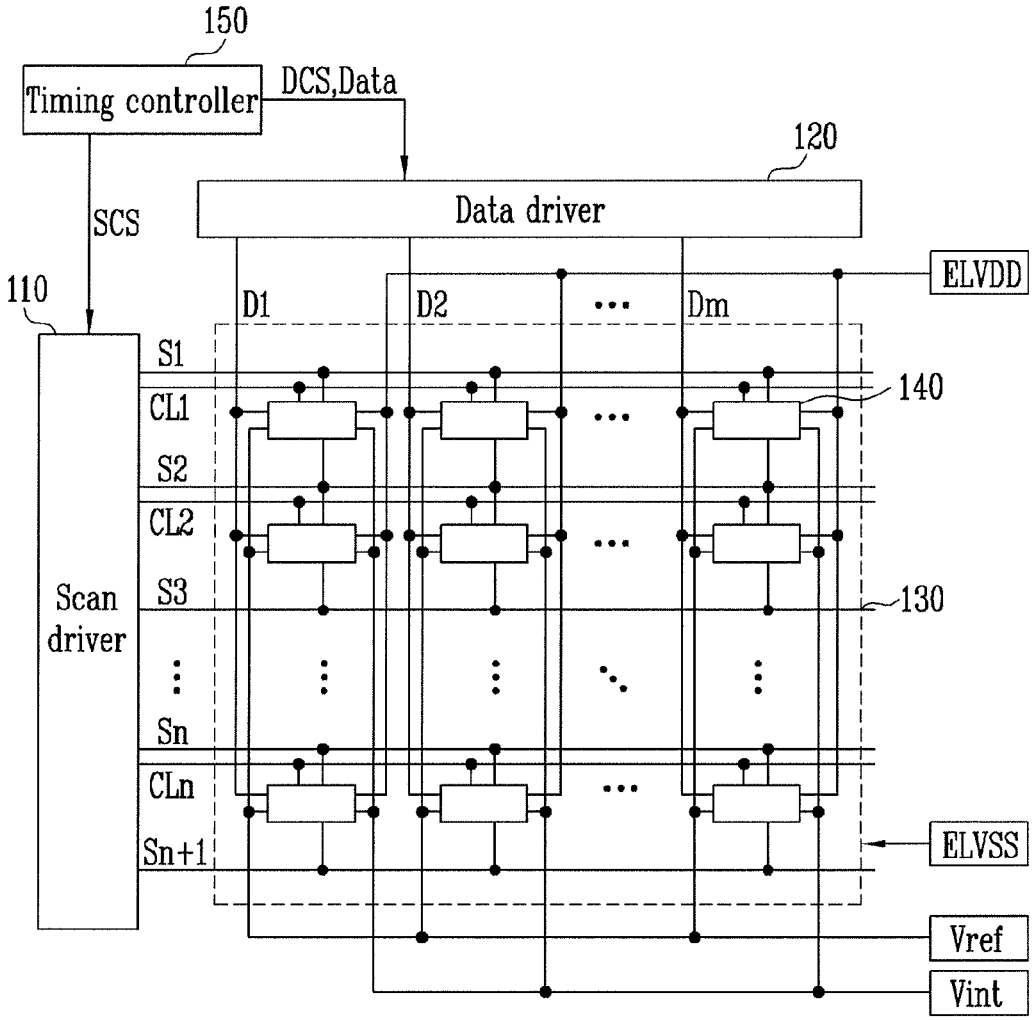
FIG. 2 is a schematic diagram showing an organic light emitting display device according to an embodiment of the present invention.

FIG. 2 is a schematic diagram showing an organic light emitting display device according to an embodiment of the present invention.

Referring to FIG. 2, the organic light emitting display device according to the embodiment of the present invention includes pixels 140 that are respectively coupled to scan lines S1 to Sn+1, control lines CL1 to CLn, and data lines D1 to Dm, a scan driver 110 for driving the scan lines S1 to Sn+1 and the control lines CL1 to CLn, a data driver 120 for driving the data lines D1 to Dm, and a timing controller 150 for controlling the scan driver 110 and the data driver 120.

The scan driver 110 receives a scan driving control signal SCS from the timing controller 150. The scan driver 110 generates scan signals and supplies the scan signals sequentially to the scan lines S1 to Sn+1. Also, the scan driver 110 generates control signals and supplies the control signals sequentially to the control lines CL1 to CLn. Here, the control signals overlap with the scan signals during a first period, or a first portion, of a time period when the scan signals are supplied. For example, the control signal is supplied to an $i^{th}$ (i is a natural number) control line CLi during the first period of the time period when the scan signal is supplied to the $i^{th}$ scan line Si. The control signal has a voltage having a same polarity (for example, a high level voltage) as the scan signal.

The data driver 120 receives a data driving control signal DCS from the timing controller 150. The data driver 120 supplies the data signals to the data lines D1 to Dm synchronously with the scan signals.

The timing controller 150 generates a data driving control signal DCS and a scan driving control signal SCS corresponding to synchronization signals supplied from the outside. The data driving control signal DCS is supplied to the data driver 120 and the scan driving control signal SCS is supplied to the scan driver 110. The timing controller 150 also supplies data Data supplied from the outside to the data driver 120.

A display region 130 receives a first power ELVDD, a second power ELVSS, a reference voltage Vref, and an initial power Vint from the outside, to be supplied to the respective pixels 140. The respective pixels 140 receive the first power ELVDD, the second power ELVSS, the reference voltage Vref, and the initial power Vint, and generate light corresponding to the data signals.

Here, the first power ELVDD, the voltage Vdata corresponding to the data signal, and the voltages of the reference power supply Vref and the initial power supply Vint are set in accordance with the following equation 1.

$$ELVDD > Vdata\ Vref \geq Vint \qquad \text{Equation 1}$$

Referring to equation 1, the reference power Vref is set as a voltage equal to or lower than the voltage Vdata corresponding to the data signal. The initial power Vint is set as a voltage lower than the reference power Vref. More precisely the initial power Vint is set as a voltage lower than the voltage obtained by subtracting the threshold voltage of the driving transistor from the reference voltage Vref. Meanwhile, although not included in equation 1, the second power ELVSS is set as a low voltage for current to flow from the first power ELVDD through the organic light emitting diode OLED. For example, the power supply ELVSS is set as a voltage lower than the reference power Vref.

Meanwhile, the pixel 140 positioned on the $i^{th}$ (i is a natural number) horizontal line is coupled to the $i^{th}$ scan line Si, the $i^{th}$ control line CLi, and the $i+1^{th}$ scan line Si+1. The pixel 140 according to the embodiment includes a plurality of NMOS-type transistors, and supplies current that compensates for the threshold voltage of the driving transistor to the organic light emitting diode.

Figure 3:
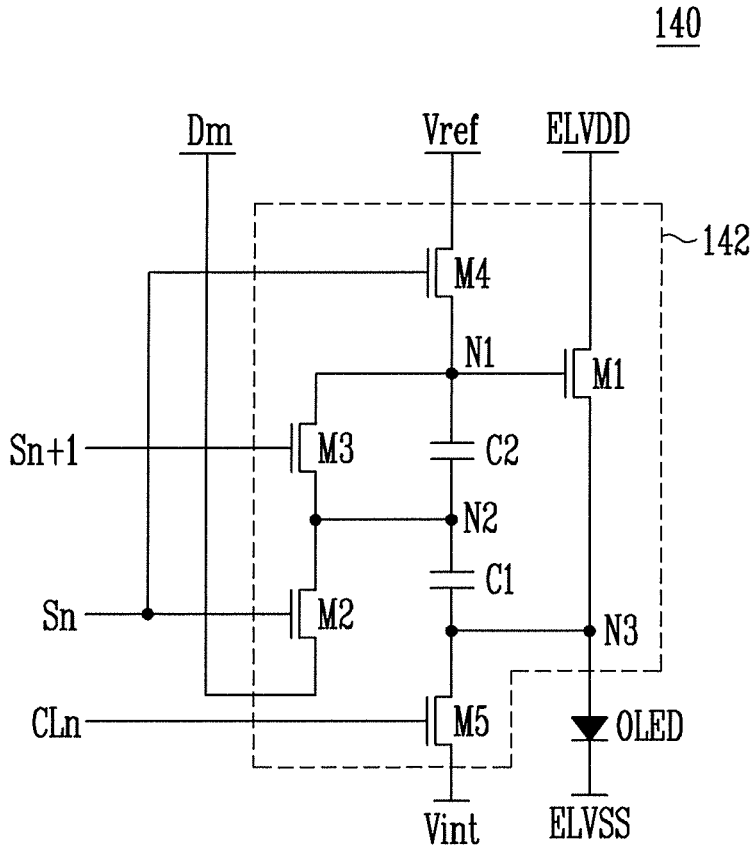
FIG. 3 is a circuit diagram showing an embodiment of a pixel of FIG. 2.

FIG. 3 is a circuit diagram showing an embodiment of a pixel of FIG. 2. For convenience of explanation, in FIG. 3, a pixel 140 positioned on an $n^{th}$ horizontal line and coupled to an $m^{th}$ data line Dm will be described.

Referring to FIG. 3, the pixel 140 according to the embodiment of the present invention includes an organic light emitting diode OLED, and a pixel circuit 142 that is coupled to the data line Dm, scan lines Sn and Sn+1, and a control line CLn for controlling the organic light emitting diode OLED.

The anode electrode of the organic light emitting diode OLED is coupled to the pixel circuit 142, and the cathode electrode thereof is coupled to a second power supply ELVSS. Such an organic light emitting diode OLED generates light having a brightness (e.g., a predetermined brightness) corresponding to a current supplied from the pixel circuit 142.

The pixel circuit 142 is charged with a voltage corresponding to the data signal supplied to the $m^{th}$ data line Dm when a scan signal is supplied to the $n^{th}$ scan line Sn, and the threshold voltage of a first transistor, and supplies current corresponding to the charged voltage to the organic light emitting diode OLED when a scan signal is supplied to the $n+1^{th}$ scan line Sn+1. To this end, the pixel circuit 142 includes first to fifth transistors M1 to M5, a first capacitor C1 and a second capacitor C2.

A gate electrode of the first transistor M1 is coupled to a first node N1, a first electrode thereof is coupled to a first power supply ELVDD, and a second electrode thereof is coupled to the anode electrode of the organic light emitting diode OLED (at a third node N3). The first transistor M1 controls an amount of current supplied to the organic light emitting diode OLED corresponding to the voltage applied to the first node N1.

The gate electrode of the second transistor M2 is coupled to the $n^{th}$ scan line Sn, the first electrode thereof is coupled to the $M^{th}$ data line Dm, and the second electrode thereof is coupled to a second node N2. The second transistor M2 is turned on when the scan signal is supplied to the scan line Sn to electrically couple the data line Dm to the second node N2.

The gate electrode of the third transistor M3 is coupled to the $n+1^{th}$ scan line Sn+1, the first electrode thereof is coupled to the second node N2, and the second electrode thereof is coupled to the first node N1 (that is, the gate electrode of the first transistor M1). The third transistor M3 is turned on when the scan signal is supplied to the $n+1^{th}$ scan line Sn+1 to electrically couple the first node N1 to the second node N2.

The gate electrode of the fourth transistor M4 is coupled to the $n^{th}$ scan line Sn, the first electrode thereof is coupled to the reference power supply Vref, and the second electrode thereof is coupled to the first node N1. The fourth transistor M4 is turned on when the scan signal is supplied to the $n^{th}$ scan line Sn to supply the voltage of the reference power supply Vref to the first node N1.

The gate electrode of the fifth transistor M5 is coupled to the $n^{th}$ control line CLn, the first electrode thereof is coupled to the third node N3, and the second electrode thereof is coupled to the initial power supply Vint. The fifth transistor M5 is turned on when the control signal is supplied to the $n^{th}$ control line CLn to supply the initial power Vint to the third node N3.

The first capacitor C1 and the second capacitor C2 are coupled between the first node N1 and the third node N3 in series. The common node between the first capacitor C1 and the second capacitor C2 is coupled to the common node between the second transistor M2 and the third transistor M3 (that is, the second node N2). Here, the second capacitor C2 and the third transistor M3 are coupled between the first node N1 and the second node N2 in parallel.

Figure 4:
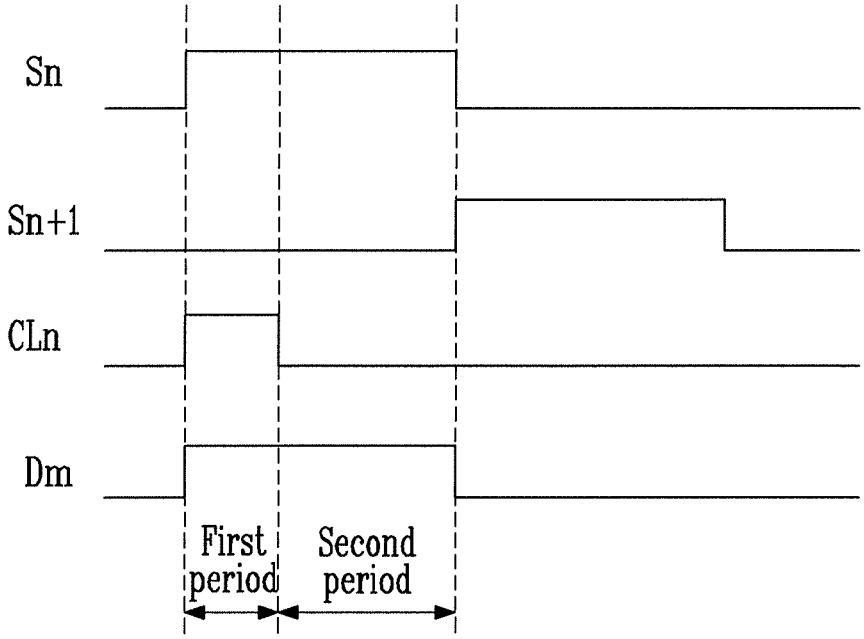
FIG. 4 is a waveform view showing a driving method of the pixel of FIG. 3.

FIG. 4 is a waveform view showing a driving method of the pixel of FIG. 3.

Explaining the operating process of the pixel 140 of the embodiment in detail in reference to FIGS. 3 and 4, first the scan signal is supplied to the $n^{th}$ scan line Sn and the control signal is supplied to the control line CLn during a first period, or a first portion, of a time period when the scan signal is supplied to the scan line Sn.

When the scan signal is supplied to the scan line Sn, the second transistor M2 and the fourth transistor M4 are turned on. When the second transistor M2 is turned on, the data signal is supplied from the data line Dm to the second node N2. When the fourth transistor M4 is turned on, the reference power Vref is supplied to the first node N1.

When the control signal is supplied to the control line CLn, the fifth transistor M5 is turned on. When the fifth transistor M5 is turned on, the initial power is supplied to the third node N3. Here, the initial power Vint is set as a voltage that allows the organic light emitting diode OLED to be turned off. Accordingly, light is not generated from the organic light emitting diode OLED during this period.

Thereafter, the supply of the control signal to the control line CLn is stopped for a second period or second portion of the time period when the scan signal is supplied to the scan line Sn. When the supply of the control signal to the control line CLn is stopped, the fifth transistor M5 is turned off. When the fifth transistor M5 is turned off, the voltage of the third node N3 is raised to the voltage obtained by subtracting the threshold voltage of the first transistor M1 from the voltage of the reference power supply Vref.

More specifically, during the first period of the time period when the scan signal is supplied to the scan line Sn, the voltage of the first node N1 is set to the reference power Vref and the voltage of the third node N3 is set to the initial power Vint. Here, the voltage of the initial power supply Vint is set as a voltage lower than the voltage obtained by subtracting the threshold voltage of the first transistor M1 from the voltage of the reference power supply Vref. Then, when the fifth transistor M5 is turned off, the voltage of the third node N3 is raised to the voltage obtained by subtracting the threshold voltage of the first transistor M1 from the voltage of the reference power supply Vref.

In this case, the second capacitor C2 between the second node N2 and the first node N1 is charged with a voltage Vdata-Vref, and the first capacitor C1 between the second node N2 and the third node N3 is charged with a voltage Vdata-Vref+Vth(M1).

Thereafter, the supply of the scan signal to the $n^{th}$ scan line Sn is stopped so that the second transistor M2 and the fourth transistor M4 are turned off, and a scan signal is supplied to the $n+1^{th}$ scan line Sn+1 so that the third transistor M3 is turned on. When the third transistor M3 is turned on, the first node N1 is coupled electrically to the second node N2. In this case, a voltage across the second capacitor C2 is set to 0, and the voltage Vgs(M1) between the gate electrode and the source electrode of the first transistor M1 is equal to the voltage charged in the first capacitor C1. In other words, the voltage between the gate electrode and the source electrode of the first transistor M1 is set by the following equation 2.

$$Vgs(M1)=Vdata-Vref+Vth(M1) \quad \text{Equation 2}$$

The amount of current flowing to the organic light emitting diode OLED corresponds to the voltage Vgs of the first transistor M1 in accordance with the following equation 3.

$$Ioled=\beta(Vgs(M1)-Vth(M1))^2=\beta\{(Vdata-Vref+Vth(M1))-Vth(M1)\}^2=\beta(Vdata-Vref)^2 \quad \text{Equation 3}$$

Referring to equation 3, the current flowing to the organic light emitting diode OLED is determined according to a voltage difference between the voltage Vdata of the data signal and the reference power Vref. Here, the reference power Vref is a fixed voltage, so that the current flowing to the organic light emitting diode OLED is determined by the data signal. In other words, in the embodiment of the present invention, an image having a uniform brightness can be displayed, irrespective of deviations in the threshold voltages of the first transistors M1 of different pixels.

Figure 5:
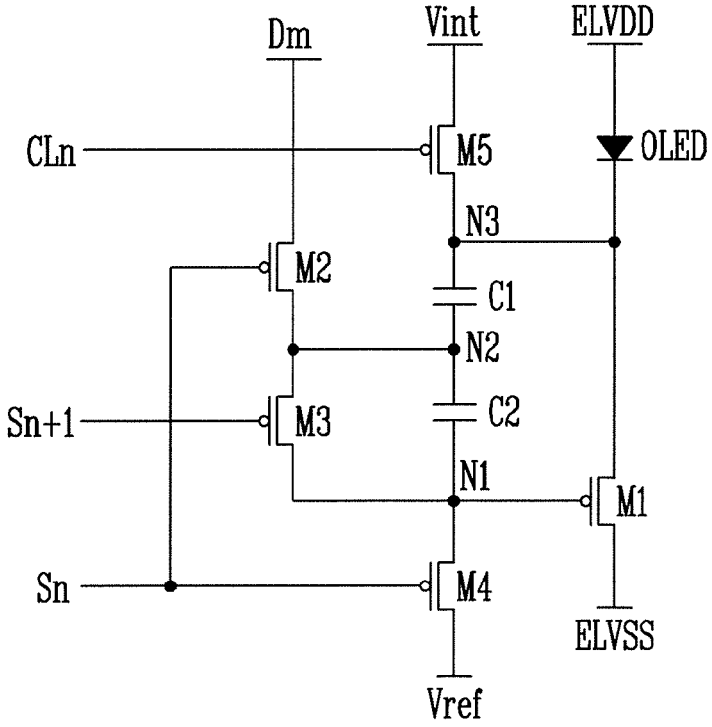
FIG. 5 is a circuit diagram showing another embodiment of a pixel of FIG. 2.

Meanwhile, although NMOS transistors are shown in FIG. 3, the present invention is not limited thereto. For example, the NMOS transistors in FIG. 3 may be changed to PMOS transistors as shown in FIG. 5. In this case, the polarity of the waveforms shown in FIG. 4 is inverted, and supplied having substantially the same operating process.

While the present invention has been described in connection with certain exemplary embodiments, it is to be understood that the invention is not limited to the disclosed embodiment, but is instead intended to cover various modifications and equivalent arrangements included within the spirit and scope of the appended claims, and equivalents thereof.

What is claimed is:

1. A pixel, comprising:

an organic light emitting diode having a cathode electrode coupled to a second power supply;

a first transistor for controlling an amount of current flowing from a first power supply to the second power supply through the organic light emitting diode;

a second transistor coupled to a data line and turned on when a scan signal is supplied to an $i^{th}$ (i is a natural number) scan line;

a third transistor coupled between the second transistor and a gate electrode of the first transistor and turned on when a scan signal is sequentially supplied to an $i+1^{th}$ scan line after the scan signal is supplied to the $i^{th}$ scan line;

a fourth transistor coupled between the gate electrode of the first transistor and a reference power supply and turned on when the scan signal is supplied to $i^{th}$ the scan line;

a fifth transistor coupled between an anode electrode of the organic light emitting diode and an initial power supply and turned on when a control signal is supplied to a control line;

a first capacitor coupled between the anode electrode of the organic light emitting diode and a node between the second transistor and the third transistor; and a second capacitor separate from the third transistor and coupled between the node and the gate electrode of the first transistor.

2. The pixel as claimed in claim 1, wherein the fifth transistor is turned on during a portion of a time period when the second transistor is turned on.

3. The pixel as claimed in claim 2, wherein the fifth transistor is turned off during a remaining portion of the time period when the second transistor is turned on.

4. The pixel as claimed in claim 2, wherein the fifth transistor is turned on concurrently with the second transistor.

5. The pixel as claimed in claim 1, wherein the reference power supply has a voltage greater than a voltage of the initial power supply.

6. The pixel as claimed in claim 1, wherein a data signal is supplied to the data line when the scan signal is supplied to the $i^{th}$ scan line, a voltage of the data signal being greater than or equal to a voltage of the reference power supply.

7. An organic light emitting display, comprising:

a scan driver for supplying scan signals sequentially to scan lines and supplying control signals sequentially to control lines;

a data driver for supplying data signals to data lines in accordance with the scan signals; and pixels at crossing regions of the scan lines, the control lines and the data lines, wherein a pixel of the pixels positioned at an $i^{th}$ (i is a natural number) scan line of the scan lines comprises:

an organic light emitting diode having a cathode electrode coupled to a second power supply;

a first transistor for controlling an amount of current flowing from a first power supply to the second power supply through the organic light emitting diode;

a second transistor coupled to a data line of the data lines and turned on when the scan signal is supplied to the $i^{th}$ scan line;

a third transistor coupled between the second transistor and a gate electrode of the first transistor and turned on when a scan signal is sequentially supplied to an $i+1^{th}$ scan line of the scan lines after the scan signal is supplied to the $i^{th}$ scan line;

a fourth transistor coupled between the gate electrode of the first transistor and a reference power supply and turned on when the scan signal is supplied to the $i^{th}$ scan line;

a fifth transistor coupled between an anode electrode of the organic light emitting diode and an initial power supply and Parried on when the control signal is supplied to an $i^{th}$ control line of the control lines;

a first capacitor coupled between the anode electrode of the organic light emitting diode and a node between the second transistor and the third transistor; and a second capacitor separate from the third transistor and coupled between the node and the gate electrode of the first transistor.

8. The organic light emitting display as claimed in claim 7, wherein a voltage of a data signal supplied to the data line is greater than or equal to a voltage of the reference power supply.

9. The organic light emitting display as claimed in claim 7, wherein the initial power supply has a voltage lower than a voltage obtained by subtracting a threshold voltage of the first transistor from a voltage of the reference power supply.

10. The organic light emitting display as claimed in claim 9, wherein the initial power supply is set at a voltage for turning the organic light emitting diode off.

11. The organic light emitting display as claimed in claim 7, wherein the scan driver is configured to supply the control signal to the $i^{th}$ control line during a portion of a time period when the scan signal is supplied to the $i^{th}$ scan line.

12. The organic light emitting display as claimed in claim 11, wherein the control signal is not supplied to the $i^{th}$ control line during a remaining portion of the time period when the scan signal is supplied to the $i^{th}$ scan line.

13. The organic light emitting display as claimed in claim 11, wherein the scan driver is configured to supply the control signal to the $i^{th}$ control line concurrently with the scan signal supplied to the $i^{th}$ scan line.

* * * * *